US006021914A

United States Patent [19]

Schmidt

[11] Patent Number: 6,021,914

[45] Date of Patent: Feb. 8, 2000

[54] HORS D'OEUVRE TRAY

[75] Inventor: George Schmidt, Douglaston, N.Y.

[73] Assignee: M. Kamenstein, Inc.

[21] Appl. No.: 09/178,280

[22] Filed: Oct. 23, 1998

Related U.S. Application Data

[60] Provisional application No. 60/063,214, Oct. 24, 1997.

[51] Int. Cl.[7] ..... A47G 19/00

[52] U.S. Cl. ..... 220/574; 220/23.83; 220/575; 248/311.2; D7/553

[58] Field of Search ..... 220/23.83, 574, 220/575; D7/553, 566; 248/311.2

[56] References Cited

U.S. PATENT DOCUMENTS

| | | | |
|---|---|---|---|
| 4,516,685 | 5/1985 | French | 220/23.83 |
| 5,085,391 | 2/1992 | Berger et al. | 220/23.83 X |
| 5,111,960 | 5/1992 | Zilliox | 220/575 |
| 5,114,038 | 5/1992 | Quensen | 220/575 |
| 5,234,125 | 8/1993 | Roberts | 220/574 |
| 5,346,070 | 9/1994 | McSpadden | 220/575 X |
| 5,419,455 | 5/1995 | Russeau | 220/575 |
| 5,853,104 | 12/1998 | Rathjen | 220/23.83 X |

*Primary Examiner*—Steven Pollard

*Attorney, Agent, or Firm*—Robert A. Koons, Jr.; James W. Bolcsak; Pepper Hamilton LLP

[57] ABSTRACT

A nestable tray for holding food and a beverage glass at social gatherings, wherein the tray has an aperture and a slot continuous with the aperture and extending to the exterior of the tray for receiving the stem of a stemmed glass.

3 Claims, 3 Drawing Sheets

HORS D'OEUVRE TRAY

This application claims benefit of Provisional Application No. 60/063,214 Oct.24, 1997.

BACKGROUND OF THE INVENTION

1. Field of the Invention

The field of this invention relates to trays for holding both food and beverage at social gatherings. More specifically, the invention relates to a tray for holding portions of food as well as a beverage glass at social gatherings, where the beverage glass held may be a stemware glass.

2. Description of the Related Art

There has long been a need for a tray for use at social gatherings which can be used by a participant at the gathering for carrying morsels of food such as hors d'oeuvres along with a container of a beverage, where the beverage might optionally be in a conventional tumbler style glass or in a piece of stemware. Some of the characteristics of a highly desirable such tray are as follows.

A tray for the use cited above should be capable of being manufactured at low cost, should offer the option of manufacturing by more than one process, and should be designed to allow nesting when stacked to maximize the number of packages of such trays which can be placed in a given amount of shelf space in a retail store. The tray should be capable of holding food such as an hors d'oeuvre in one area of the tray while holding a beverage container in a separate area of the tray. This arrangement will allow a user to carry both food and beverage with one hand while walking about at a social gathering, freeing a hand for social interaction such as shaking hands and making gestures. Preferably, the tray should also be of a configuration which will allow a stemware beverage container with a high center of gravity when filled to be securely and stably carried on the tray. Also, the tray should still accommodate the stemware container when the tray is placed on a table during the addition of food to the tray. But, the tray should be of a configuration which will also accommodate a cup or tumbler of beverage. Also, a preferred tray will have at least one feature in its shape which will allow a user to discern the orientation of the tray easily by feel, without having to interrupt social interaction to look at the tray.

One attempt to provide a tray with these desired characteristics was disclosed by French in U.S. Pat. No. 4,516,685. French disclosed a tray with a flat recessed portion for holding food, and a slotted portion disposed at the periphery of the tray for holding a stemmed glass. The tray of French has the slotted portion for holding a stemmed glass configured as an extension of a raised lip of the tray, extending outwardly from the tray. When this tray is placed on a flat surface such as a table, the foot of a stemmed glass will be accommodated under the slotted portion. However, if a beverage container such as a cup or tumbler is placed on the slotted portion, the tray would tend to tip from the weight of the beverage. Also, a tumbler or cup would not be securely held in place on the smooth upper surface of the slotted portion while the user walks about at a social gathering. A beverage container of these types would not be stable when carried and could easily slide from the tray in accordance with the French disclosure.

Another attempt to satisfy the need for this type of tray was disclosed by Stevens in U.S. Pat. No. 4,607,758. The tray according to Stevens has two distinct portions defined by vertical walls: a portion for holding food and a portion for holding a beverage container. The tray of Stevens was disclosed as having a slot extending from the interior of the beverage portion, through the vertical wall of this portion, to the exterior. The slot allows a stemmed beverage container to be accommodated by the beverage portion with the bowl of the container held within the beverage portion and the stem and foot suspended below the tray. The Stevens tray also has bottom ridges molded onto the underside of its structure to allow the tray to be stacked. The tray according to Stevens as shown therein cannot be nested however. One of these trays can be placed upon another identical tray in a stacked arrangement for storing by the user or on a retail store shelf. The tray as disclosed does not nest though. A stack of n number of these trays will have a total height which is equal to n times the height of one tray, plus the height of a bottom ridge. The tray disclosed by Stevens is not suited for efficient storage then.

Also, the tray according to Stevens by virtue of its shape and especially because of the bottom ridge needed for its being able to stack, is suited for manufacturing by injection molding. Such a tray would not be well suited for manufacturing by a thermoforming or a compression molding process however.

Powell has disclosed yet another tray in U.S. Pat. No. 4,989,742 with some desired characteristics. The tray apparatus of this disclosure comprises a base tray having two compartments separated by a hand hold portion. One compartment is intended for holding a beverage container such as a cup with handle or a tumbler. The second compartment is intended for holding food directly or for holding a food containing receptacle such as a plate. The base tray of the Powell tray apparatus is adapted for securely engaging the beverage container used or the food receptacle used by locking means. The tray apparatus of the Powell disclosure is not suited for holding a stemmed beverage container stably near the container's center of gravity however, lacking any slot as provided in the French or Stevens disclosures. Also, the complicated shape of the Powell tray apparatus comprises undercuts which would be disadvantageous for inexpensive manufacturing.

A fourth tray configuration has been disclosed by Russeau in U.S. Pat. No. 5,419,455. In this configuration a plate is provided with a center portion for holding food and an outer periphery having a notch therethrough leading to an aperture for holding a stemmed glass. The aperture is surrounded by a raised rim that is coplanar with the upper edge of the periphery and also surrounded by a lower lip coplanar with the center portion. A base foot element is provided under the central portion for elevating the lip for accommodating the foot of a piece of stemware when the tray of this disclosure is being held on a flat surface. The tray of this disclosure has among its disadvantages the raised rim surrounding the aperture for the stemmed beverage container. This raised rim makes the disclosed tray poorly suited for stably carrying a cup or tumbler type of beverage container. These types of containers would have a tendency to slide from the raised rim into the food holding center portion. Another problem with the tray of this disclosure is that the provision of the base foot element and the complicated shape of the raised rim element surrounding the aperture would make the mold for manufacturing a tray of this configuration less desirable.

Brown in U.S. Design Pat. No. 398,481 has disclosed yet another configuration for a tray intended for satisfying some of the needs outlined above. The tray in this disclosure comprises a food holding portion and a beverage holding portion. The beverage holding portion has a slot provided for allowing a handle of a cup or mug to be accommodated, or for holding a stemmed glass in suspension from the tray.

Deep recessed areas are also provided in the food holding portion which appear to have utility in holding the tray. However, the tray of this design has such deep recesses that more material would be needed for its manufacture than is necessary for satisfying the objects of the present invention. It appears that the tray of Brown was intended for holding a plate of food rather than directly holding food. The tray of the present invention overcomes the problems of the disclosed trays discussed above and satisfies these objects as outlined hereinbelow.

OBJECTS OF THE INVENTION

Accordingly, it is an object of the invention to provide a convenient and inexpensive article of manufacture for use at social gatherings for holding portions of food and simultaneously holding a beverage container.

It is another object of the invention to provide an improved tray for use in the holding of food and beverage for social gathering applications, where the beverage is contained in a stemware container such as a glass comprising a bowl, a stem and a foot.

It is another object of the present invention to provide a tray which has separated areas for holding food and holding a beverage container.

It is another object of the present invention to provide a tray which is nestable, to provide for compact packaging to maximize the supply of packaged trays in a given amount of shelf space in a store.

It is another object of the present invention to provide a tray which is nestable, where the tray construction allows for a stack of nested trays which will be stable when stacked tall, for convenient storage of the trays in bulk with minimal tipping of the tray stacks.

It is another object of the present invention to provide a tray which is able to hold a cup or glass stably thereon while the tray is being held by an ambulating person, and also while the tray is at rest on a flat surface.

It is another object of the present invention to provide a tray which is able to hold a piece of stemware by suspension from the bowl of the stemware while being carried by an ambulating person.

It is another object of the present invention to provide a tray, which tray is able to provide a user with tactile referencing of where the holder's hand is gripping the perimeter of the hors d'oeuvre tray.

It is another object of the present invention to provide a tray able to be manufactured by any of the following manufacturing methods: thermoforming, injection molding, or compression molding.

It is yet another object of the present invention to provide a tray which minimizes the amount of material needed for its construction, to thus minimize the cost of manufacturing.

Other objects will become apparent from the description of the invention which follows.

SUMMARY OF THE INVENTION

Briefly, the invention is a nestable tray providing a first portion for holding food and a second portion for holding a beverage container. The beverage holding portion comprises a flat area for accommodating beverage containers such as a tumbler or a cup, and the beverage portion also has a slot provided for accommodating a stemmed glass.

Preferably, the tray of the invention also comprises a raised rim around its periphery, the rim having an undulating scalloped profile.

DETAILED DESCRIPTION OF THE INVENTION

We have invented a product convenient for the serving of food and beverage at social gatherings. Said product has a novel combination of features heretofore not found in a serving product.

The inventive tray possesses a unique combination of attributes. It is capable of holding foodstuff such as served at parties as snacks or hors d'oeuvres, along with a beverage glass which may be a stemmed beverage glass, while being held while being capable of manufacture using a thermoforming process or an injection molding process.

Figure 1:
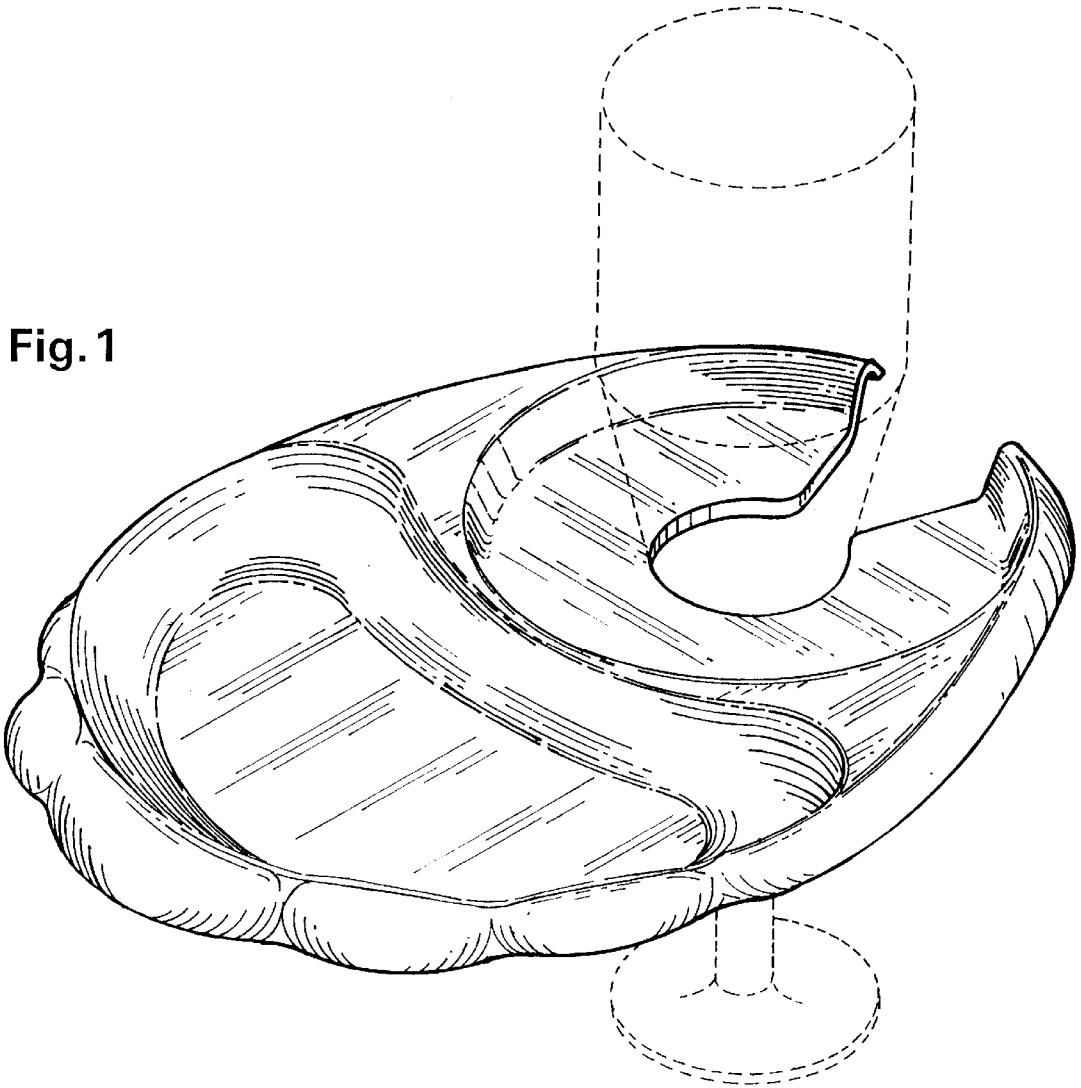
FIG. 1 illustrates a perspective view of a tray in accordance with the invention, and also showing the way that a stemmed beverage container is held by the tray.
Figure 4:
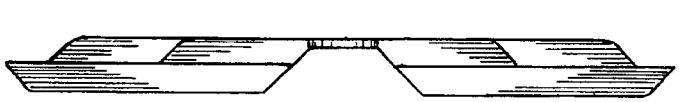
FIG. 4 illustrates a front elevation view of a tray in accordance with the invention.
Figure 2:
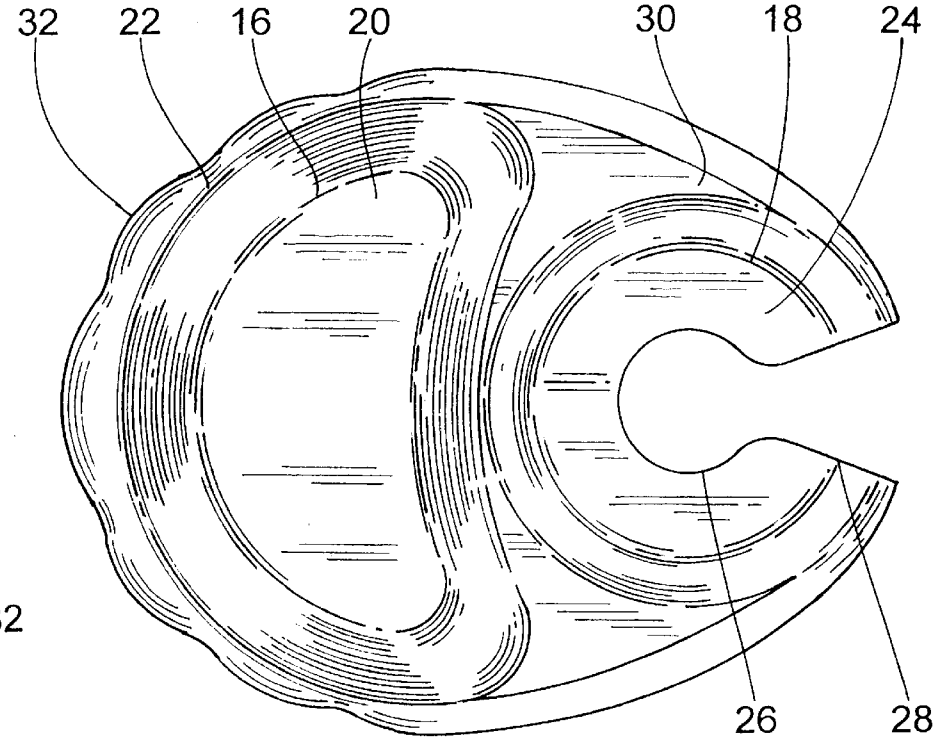
FIG. 2 illustrates a top plan view of a tray in accordance with the invention.
Figure 3:
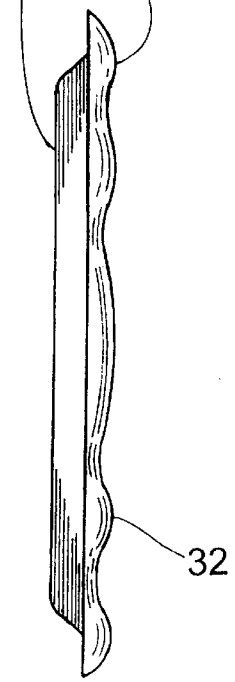
FIG. 3 illustrates a back elevation view of a tray in accordance with the invention.
Figure 5:
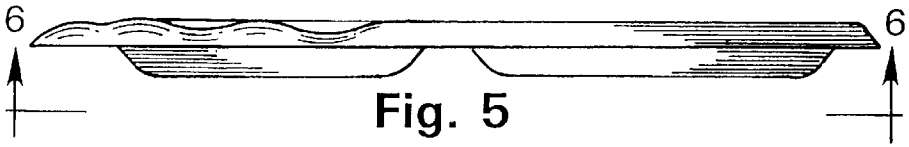
FIG. 5 illustrates a left side view of a tray in accordance with the invention.
Figure 6:
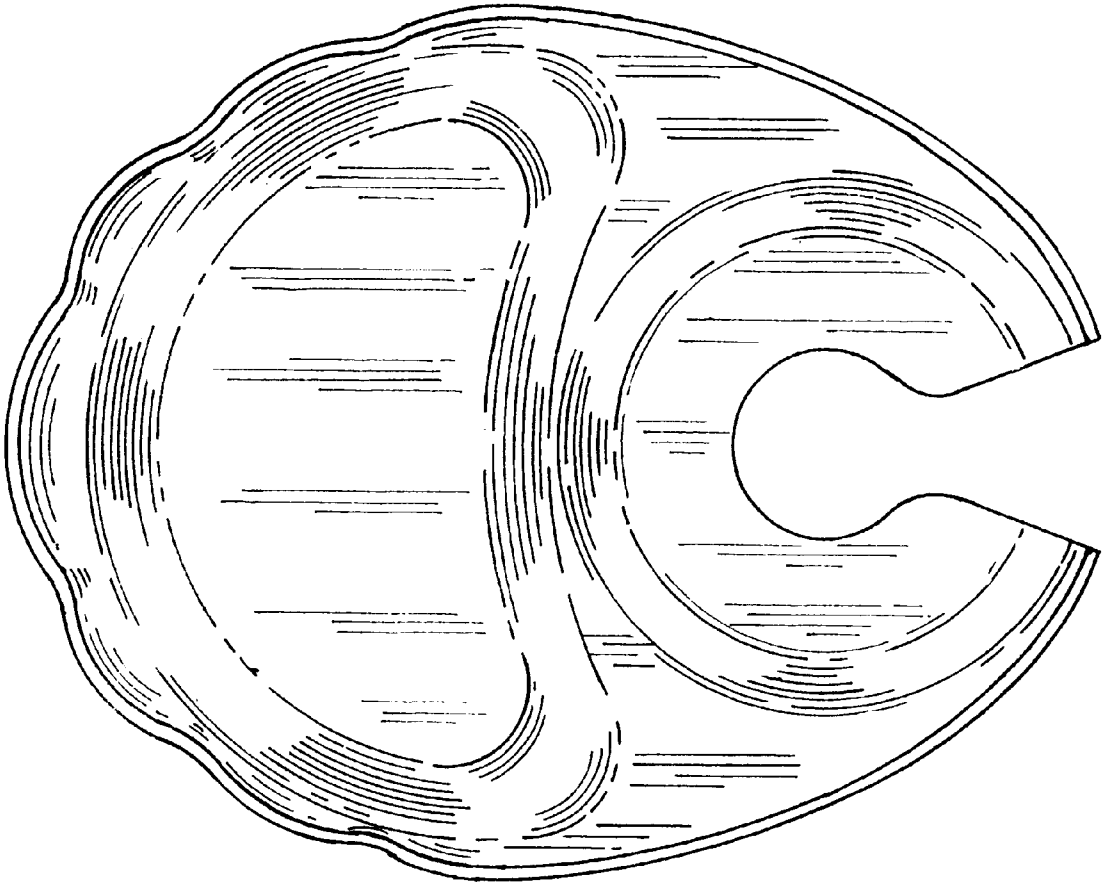
FIG. 6 illustrates a bottom plan view of a tray in accordance with the invention.

The invention will now be described through an illustrative example. The example is not intended to limit the scope of the invention defined in the appended claims. As depicted in FIG. 1, a tray according to the invention is generally flat and of generally oval overall shape, having an upper face 12 and a lower face 14, and having an imaginary central axis running longitudinally through the tray. The tray comprises a food holding portion 16 and a beverage holding portion 18 adjacent to each other along the imaginary axis. The food holding portion 16 further comprises a central flat recessed area 20 for holding food and a raised rim 22 about the periphery of the flat recessed area, the raised rim extending generally upward and outward, and then turning downward and outward in arcuate profile.

The beverage holding portion 18 comprises a central flat recessed area 24 for supporting a beverage container, the recessed area being coplanar with the central area of the food holding portion 20; a central aperture 26 generally circular in shape extending through the central recessed area and sized to receive a stem of a stemmed glass; an outward flaring slot 28 extending from and continuous with the central recessed area aperture to the exterior of the tray, for admitting and securing a stem of a stemmed beverage container; and a raised rim 30 about the periphery of the flat recessed area, the raised rim extending generally upward and outward, and then turning downward and outward in arcuate profile, with the beverage holding portion rim being continuous with the rim of the food holding portion and forming a separating ridge between the beverage holding portion and the food holding portion.

The tray rim further comprises a plurality of undulating scallops 32 depending around the periphery of the food holding area distal to the beverage holding portion.

In use, a user can grasp the tray according to the invention with a hand located below the tray for supporting the tray, the tray having its imaginary axis aligned with the wrist of the user, the slot of the tray distal to the wrist, and the scallops proximate to the wrist. The fingers of the user's hand may then engage the ridge from below the tray, and the user's thumb may wrap over a scallop on the upper face for securely holding the tray. The undulating scallops disposed along an end of the tray then provide tactile feedback on the position of the tray being held, so that the user has lessened need for looking at the tray in use to see if it is properly held or balanced.

Preferably, the undulating scallops increase in size as their distance from the beverage holding portion increases. This variation in size also contributes to the tactile feedback on the positioning of the tray for the user.

The flaring slot and central aperture allow the user to insert and retain a stemmed glass with the bowl of the glass supported stably with the center of gravity of the glass in close proximity to the upper face of the tray, and the stem and foot of the glass suspended below the tray. Because the central area of the beverage portion is coplanar with the central area of the food holding portion, the tray may also be used to support beverage containers such as a tumbler, a cup, a mug, or a can. The tray will not tip if supporting a beverage container when the tray is set down upon a table. If the beverage container is a stemmed glass, the beverage holding portion of the tray is raised slightly from the table but does not appear unstable.

The tray may be made from a suitable substantially rigid material such as a thermoplastic material. The tray according to the invention may be readily manufactured by one skilled in the art of fabricating plastic articles by a process selected from the group consisting of injection molding, thermoforming and compression molding. The inventive tray minimizes the amount of plastic needed for manufacturing. The tray would preferably be made from a sheet of material of uniform thickness.

A tray made in accordance with the teachings of the invention can easily be nested. When a plurality of such trays are nested one upon another to form a large stack, the total height of a stack is minimized, with the incremental height added by each tray being simply the thickness of the material used to make the tray. The undulating scallops disposed around the food holding portion serve not only to provide a user with tactile referencing of the position of a tray being held, these scallops may also contribute to the ability of the tray to be nested stably. When a stack of nested trays is pushed in a direction orthogonal to the stack, or the stack is subjected to twisting, the scallops contribute to the stability of the stack.

A tray according to the teachings of the invention may be made larger or smaller overall while still meeting the objects of the invention and such changes in size are to be included within the scope of the invention.

While the invention has been described herein with reference to a specific and preferred embodiment, it is understood that changes, modifications, substitutions and omissions may be made without departing from the spirit and scope of the invention defined in the appended claims.

I claim:

1. A nestable tray for holding food and a beverage container, comprising:

an imaginary axis;

an upper and an opposed lower face;

a food holding portion and a beverage holding portion adjacent to the food holding portion along the axis;

the food holding portion comprising: a central flat recessed area for holding food, and a raised rim about the periphery of the flat recessed area, wherein the raised rim extends generally upward and outward and then turns downward and outward in arcuate profile;

the beverage holding portion comprising: a central flat recessed area for supporting a beverage container, wherein the recessed area being coplanar with the central area of the food holding portion; a central aperture generally circular in shape, extending through the central recessed area and sized to receive a stem of a stemmed glass; an outward flaring slot extending from and continuous with the central recessed area aperture to the exterior of the tray for admitting and securing a stem of a stemmed beverage container; and a raised rim about the periphery of the flat recessed area, wherein the raised rim extends generally upward and outward, and then turns downward and outwards in arcuate profile;

wherein the tray rim further comprises undulating scallops depending around the periphery of the food holding area distal to the beverage holding portion.

2. The tray of claim 1 wherein the recessed area of the food holding portion is crescent shaped.

3. The tray of claim 2 wherein the undulating scallops increase in size as their distance from the beverage holding portion increases.

* * * * *